US009876280B1

(12) United States Patent
Pillans et al.

(10) Patent No.: US 9,876,280 B1
(45) Date of Patent: Jan. 23, 2018

(54) RADOME WITH RADIO FREQUENCY FILTERING SURFACE

(71) Applicant: Raytheon Company, Waltham, MA (US)

(72) Inventors: Brandon W. Pillans, Plano, TX (US); Gary A. Frazier, Garland, TX (US); Charles M. Rhoads, McKinney, TX (US)

(73) Assignee: RAYTHEON COMPANY, Waltham, MA (US)

( * ) Notice: Subject to any disclaimer, the term of this patent is extended or adjusted under 35 U.S.C. 154(b) by 45 days.

(21) Appl. No.: 14/960,849

(22) Filed: Dec. 7, 2015

(51) Int. Cl.
*H01Q 15/24* (2006.01)
*H01Q 1/42* (2006.01)
*H01Q 15/00* (2006.01)

(52) U.S. Cl.
CPC ..... *H01Q 1/422* (2013.01); *H01Q 15/0006* (2013.01); *H01Q 15/0013* (2013.01); *H01Q 15/0026* (2013.01)

(58) Field of Classification Search
CPC ..... H01Q 15/0006; H01Q 15/0013; H01Q 15/0026; H01Q 15/24
See application file for complete search history.

(56) References Cited

U.S. PATENT DOCUMENTS 5,548,289 A 8/1996 Chekroun
5,861,860 A * 1/1999 Stanek ..... H01Q 15/0013 343/708
7,436,373 B1 10/2008 Lopes et al.
7,634,248 B2 12/2009 Xu et al.
8,900,930 B2 12/2014 Moon
2003/0030519 A1 2/2003 Wyeth
2006/0114170 A1 6/2006 Sievenpiper
2010/0309539 A1 12/2010 Kaye
2014/0266300 A1 9/2014 Sherwin
2015/0295309 A1 10/2015 Manry, Jr.

OTHER PUBLICATIONS

A. Mackay et al., "Evolution of Frequency Selective Surfaces", Forum for Electromagnetic Research Methods and Application Technologies (FERMAT), 7 pages.
Benjamin Hooberman, "Everything You Ever Wanted to Know About Frequency-Selective Surface Filters but Were Afraid to Ask", May 2005, 22 pages.
E.A. Parker, "The Gentleman'S Guide to Frequency Selective Surfaces", 17th Q.M.W. Antenna Symposium, Apr. 1991, 18 pages.
Notification of Transmittal of the Written Opinion of the International Searching Authority, or the Declaration; PCT/US2016/064885; dated Jul. 26, 2017.
Notification of Transmittal of the International Search Report of the International Searching Authority, or the Declaration; PCT/US2016/064885; dated Jul. 26, 2017.

* cited by examiner

*Primary Examiner* — Hoang Nguyen
(74) *Attorney, Agent, or Firm* — Cantor Colburn LLP

(57) ABSTRACT

A system for detecting radio frequency (RF) signals includes a radome including one or more phase change material (PCM) layers disposed on an inner surface thereof and a sensor at least partially disposed within the radome. The system also includes a heat source arranged such that it can direct heat toward the inner surface of the radome and a controller that causes the heat source to direct heat towards the inner surface of the radome such that a frequency selective surface (FSS) is formed thereon.

37 Claims, 8 Drawing Sheets

RADOME WITH RADIO FREQUENCY FILTERING SURFACE

BACKGROUND

The present invention relates to a radome and, more specifically, to a radome having a surface that can be configured to filter out one more radio frequency (RF) signals.

A large number of radar systems require a radome to provide environmental protection to radio frequency and other sensors and sources placed behind the aperture. Such radomes are sometimes designed and optimized to have high performance characteristics in that they provide for minimum radio frequency (RF) loss, are ruggedized for environmental protection and are relatively light weight with little regard to low cost. These radomes can be designed for commercial and/or military applications and can be optimized to transmit or reject different frequency bands of the electromagnetic spectrum. In addition, radomes sometimes need to be resistant to and sealed against moisture, chemicals, gases and dust, plus be able to withstand wide temperature ranges and have a required color. It is often needed that designers sacrifice low cost to meet all these other requirements.

High performance radomes require careful selection and understanding of material properties that directly affect radome and antenna or phase array performance. The combination of high performance requirements and a requirement for low cost create a problem where a solution is not intuitively obvious.

Front-end RF filtering is needed in almost every phased array/communication application to limit the sensed or transmitted spectrum. That is, in some cases, a particular frequency may need to be filtered out so that it does not overpower all other frequencies. For example, consider an aircraft passing over a radio station antenna. As is passes over the antenna, both the primary and harmonic frequencies may be so large as to hide other important information in other regions of the spectrum.

Often times the properties of this filter are fixed based on established mission requirements, but a fixed filter will not let an aircraft adapt to changing conditions while in flight. Thus, in the example above, a fixed filter could be applied to block out the radio signal. However, in another location, a different source of interference could be present that is not adequately accounted for by the fixed filter. As such, in these situations, the radar system could be less useful. That is, without a tunable front end filter, the radar system may have several regions where it works less effectively depending on external conditions.

One method of dealing with such large or overpowering signals is to attenuate the entire system, operating with degraded SNR or steering the beam away from the interferer. In all these cases, the system is not operating as intended and will typically sacrifice overall performance all the time to be able to operate through these rare events.

SUMMARY

According to one embodiment of the present invention, a system for detecting radio frequency (RF) signals includes a radome including one or more phase change material (PCM) layers disposed on an inner surface thereof and a sensor at least partially disposed within the radome is disclosed. The system also includes a heat source arranged such that it can direct heat toward the inner surface of the radome and a controller that causes the heat source to direct heat towards the inner surface of the radome such that a frequency selective surface (FSS) is formed thereon.

Also disclosed is a system for filtering radio frequency (RF) signals from reaching an RF sensor that includes a radome, the radome including one or more phase change material (PCM) layers disposed on an inner surface thereof and a heat source arranged such that it can direct heat toward the inner surface of the radome. The system also includes a controller that causes the heat source to direct heat towards the inner surface of the radome such that a frequency selective surface (FSS) is formed thereon.

Also disclosed is a method of filtering signals from reaching a sensor. The method includes: providing a radome sized and configured to protect the sensor, the radome including one or more phase change material (PCM) layers disposed on an inner surface thereof; determining a frequency band to be blocked from reaching the sensor; selecting a first frequency selective surface (FSS) pattern to block the first frequency band; and directing heat at the PCM layer to cause the first FSS pattern to be formed thereon.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

As will be described below, a system and method for adaptively and/or actively filter out unwanted signals "on-the-fly" from reaching a sensor system. This may allow a sensor system to operate at peak performance while operating in hostile RF environments.

The following examples will be provided in the context of radome that houses or otherwise protects an RF system (such as a radar system). The skilled artisan will realize that the teachings herein are not limited to a radome and could be applied in any context where variable RF filtering is needed. As used herein, RF filtering includes changing the reflection, transmission, or absorption of electromagnetic energy either over a broad range of frequencies or over one or more selected bands of frequencies.

In one embodiment, a radome includes one or more layers of a phase change material (PCM) formed thereon. The following discussion, for ease, will only discuss a single PCM layer. Application of directed heat (e.g., from a laser) can cause a pattern to be formed on the PCM layer in such a manner that the layer filters out one or more particular frequencies. That is, the PCM layer can be created such it serves as a frequency selective surface (FSS) that can be changed, in flight, to adjust to changing external interferences. In one embodiment, the PCM may be caused to form a continuous, unpatterned resistive sheet of metallic character and in another, the PCM may be caused to form a continuous, unpatterned resistive sheet of insulating character.

Figure 1:
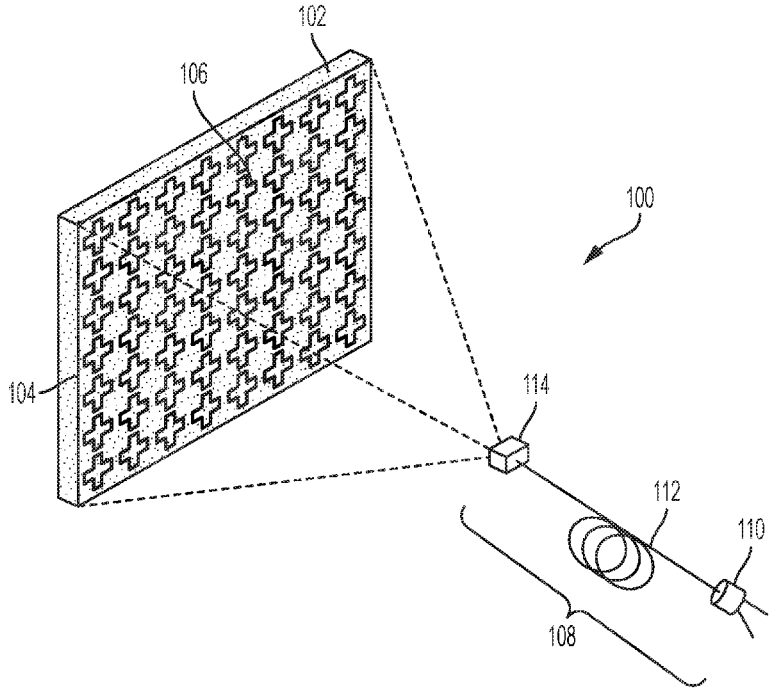
FIG. 1 shows a simplified block diagram of a system that may be used to form a frequency selective surface (FSS) on a surface such as an inner portion of a radome.

FIG. 1 shows a block diagram of a system 100 according to one embodiment. The system 100 includes a radome 102. The radome 102 can be formed of any suitable radome material. For example, the may be formed as an A-sandwich configuration, C-sandwich configurations and modified versions. The radome 102 may provide low RF loss, be ruggedized for environmental protection and have a low weight. The materials of construction can include ceramics, glasses, polyolefins, polyethylene and polypropylene with off-the-shelf color and thicknesses and may utilize pressure sensitive adhesive (PSA) between higher dielectric sheets and lower dielectric foam. Of course, the above is just an example of one radome type to which the teachings herein may be applied. Other radome types could be used including any currently known or later developed radome. Further, and as described above, the teachings herein can be applied to implements other than radomes. In particular, the teachings herein could be applied to any surface between an RF sensor system (e.g, radar) and a source of RF interference.

In one embodiment, one or more layers of a PCM material are formed on a surface of the radome 102. In FIG. 1, a single PCM layer 104 is shown. The PCM layer 102 may be formed of any PCM material. A heat source 108 may be used to form patterns or shapes 106 of the PCM layer 104 such that the PCM layer becomes a frequency selective surface that filters out one or more frequencies.

As illustrated, the heat source 108 is a laser system that includes a lasing source 110 such as laser diode, an optional laser carrying conduit 112 and a laser directing element such as gimballed mirror 114. The laser carrying conduit 112 could be omitted and the lasing source 110 and the gimballed mirror could form the heat source.

Figure 2:
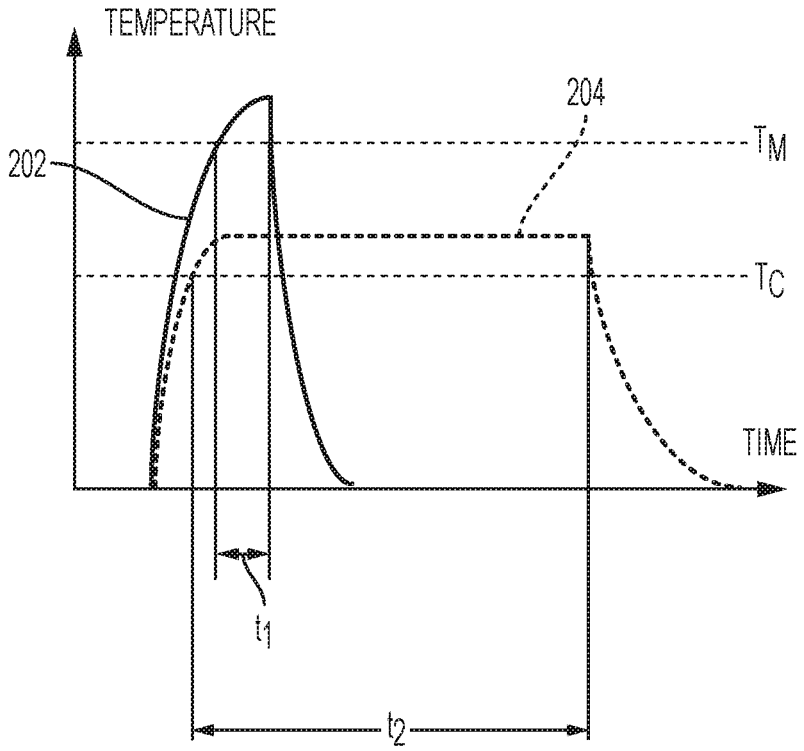
FIG. 2 shows a graph with timing and temperature characteristics of a general phase change material (PCM)

In general, the PCM layer 104 is formed of a phase change material. With reference now to FIG. 2, phase change materials (PCM) change phase state (crystalline to amorphous) with the application of heat. There is an amorphizing temperature ($T_M$) above which causes the material to be insulating. At a lower temperature there exists a crystalizing temperature ($T_C$) at which it becomes conductive. Once the material changes state, it latches in that state until the $T_M$ or $T_C$ is reached again. In some cases, the difference in resistance of up $10^5$ have been achieved.

Referring now to FIGS. 1 and 2, in one embodiment, the PCM layer 104 is formed by PCM materials into a low thermal mass sheet. Targeted application of heat to the PCM material in the PCM layer can cause regions of the PCM to have patterns 106 of high resistance to be formed on the PCM layer 104. Whether a particular region of the sheet 104 is high or low resistance is determined based on a dwell time of the heat from the heat source 108 in a particular area as indicated by heat application curves 202 and 204. In particular, if heat is applied above $T_m$ for at least $t_1$ the region will be insulating and if it is applied above $T_m$ and below $T_c$ for time $t_2$ the region will be conductive. It will be understood that, given a directable heat source, any pattern of conductive/non-conductive regions can be formed on the PCM layer. One example of a PCM material is chalcogenide.

An example of a complex PCM layer 104 can be formed of chemically pure carbon nano-tubes (CNT) having a chalcogenide PCM disposed thereon. A chalcogenide PCM may have an "ON-state" resistance (e.g., conductive) of 0.9 Ω/sq (0.027 Ω-mm) with an "OFF-state" (e.g., insulating) capacitance of 14.1 fF and resistance of 0.5 MΩ.

Figure 3:
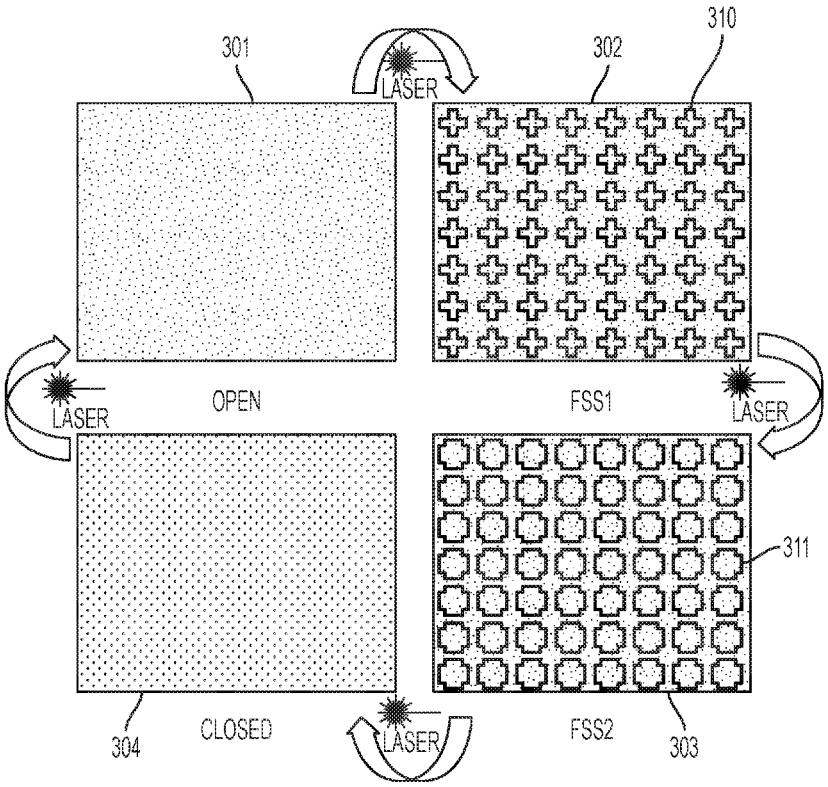
FIG. 3 shows example states of an FSS that may be formed on the inner surface of a radome.

FIG. 3 shows four different states of the PCM layer 104. These 4 states 301, 302, 303 and 304 refer, respectively to fully conductive state, a first filter state that filters a first frequency, a second filter state that filters a second frequency, different than the first frequency and a fully insulating state. The arrows shown in FIG. 3 indicate a progression from one state to the next is possible. It shall be understood that any state can go to any other state that is shown or even to unknown states. All that is required is targeted heating of the PCM layer 104.

In FIG. 3 the shapes 310, 311 shown in states 302 and 303 are defined by insulating and conducting regions of the PCM layer 104. As such, shapes 310, 311 form "RF blocking" regions. As is known in the art, a frequency-selective surface (FSS) is any thin, repetitive surface designed to reflect, transmit or absorb electromagnetic fields based on frequency. In this sense, an FSS is a type of filter in which the filtering is accomplished by virtue of the regular, periodic (usually metallic, but sometimes dielectric) pattern on the surface of the FSS. In this case, the areas between and within the shapes 310, 311 are conductive operate as the "metal" portion of an FSS. Thus, the shapes 310, 311 may be characterized by as slots in a conductor. Of course, in another embodiment, the shapes could be formed by conductive portions.

The particular shapes used for shapes 310, 311 can vary and reference may be made to known references to determine a particular shape that may be selected to filter out a particular interfering frequency. References that may be consulted include The Gentlemen's Guide to Frequency Selective Surfaces by E. A. Parker and Everything You Ever Wanted to Know About Frequency-Selective Surface Filters but Were Afraid to Ask by Benjamin Hooberman, and Evolution of Frequency Selective Surfaces by Mackay et al., all of which are incorporated herein by reference.

Figure 4A:
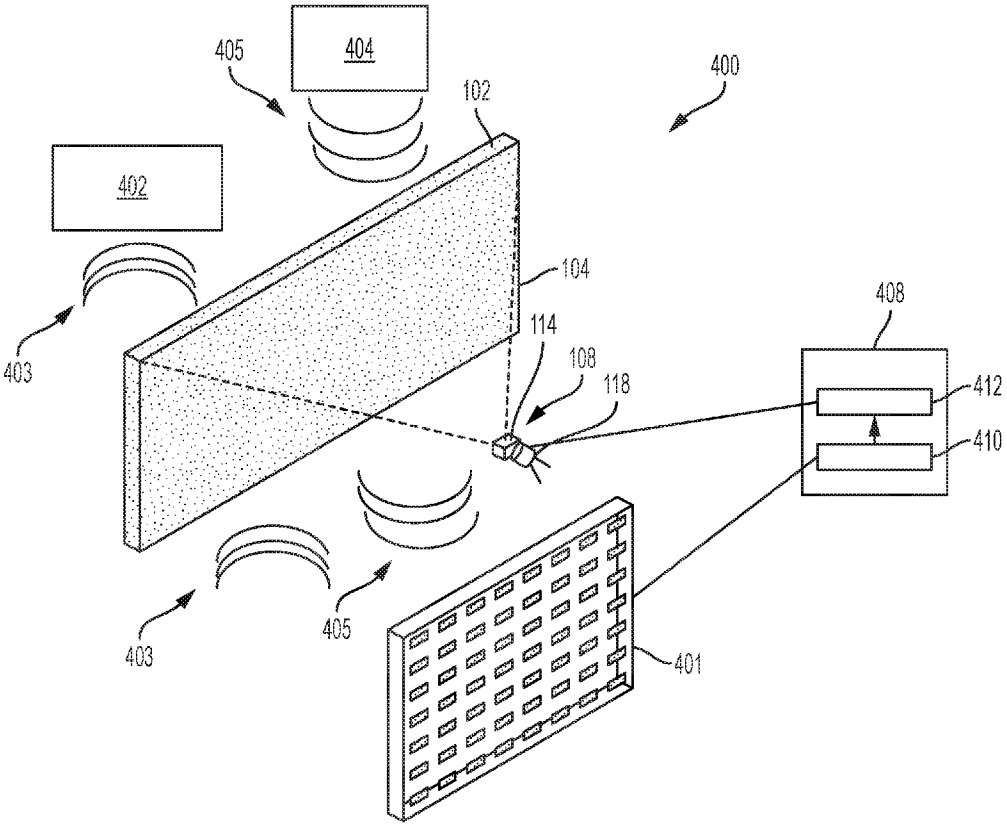
FIGS. 4A and 4B show a system with a sensor in a radome that includes an FSS on its inner surface when in two different states.
Figure 4B:
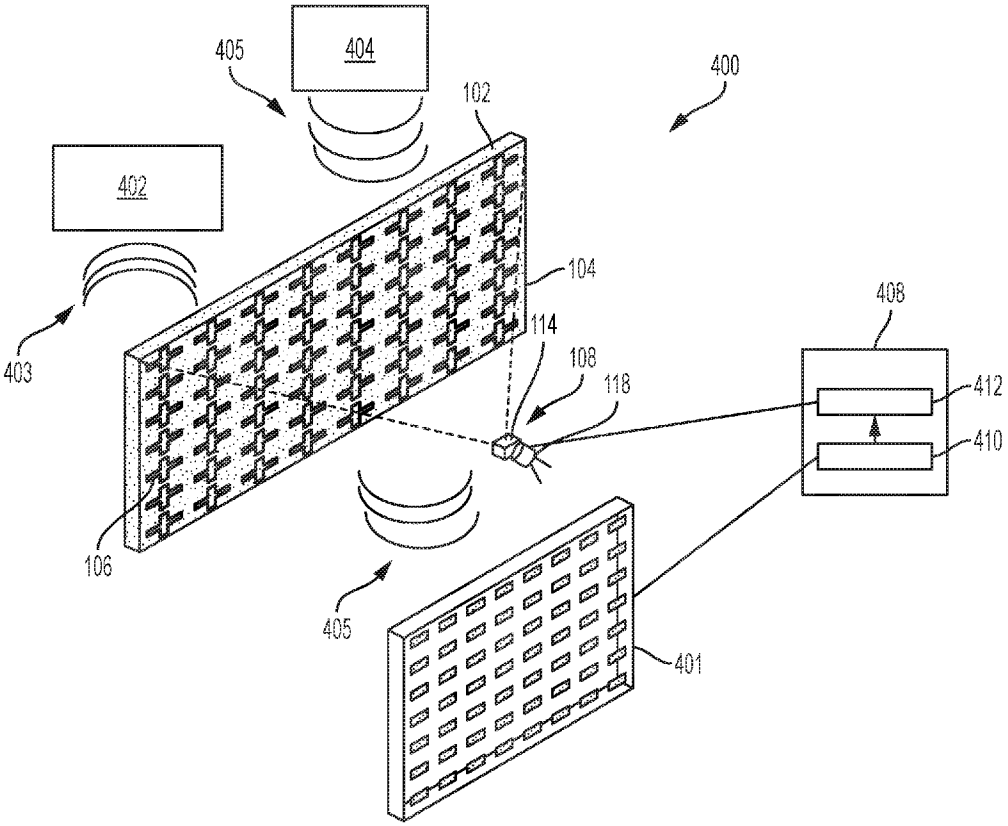

FIGS. 4*a* and 4*b* shows an embodiment of a sensor system 400 where a sensor 401 in the form an RF array is provided. The RF array may be a phased array in one embodiment. Of course, other forms of sensors that could be used in RF sensor may also be used. For example, the sensor placed behind the radome could be an optical sensor with the filtering properties of the invention herein being used to protect the optics and electronics from spurious or excessive RF energy directed to the sensor from an external source.

With reference first to FIG. 4A, the sensor 401 is configured to receive signals from one or more signal sources 402, 404. Sensor source 402 produces signal 403 that may be in certain frequency band and sensor source 403 produces signals 405 that may be in a different band. While shown as two separate sources, the sources 402, 404 could be a single source that produces frequencies in multiple bands.

The system 400 also includes a protective element such as radome 102. The protective element may surround some or all of the sensor 401 depending on the context. In this embodiment, the radome 102 includes PCM layer 106 formed thereon. As illustrated, the PCM layer 104 is configured such that it passes all frequencies in signals 403 and 405. This may occur, for example, when the PCM layer 104 is in the so-called fully conductive (or "open") state 301 described above. The sensor 401 can receive both signals 403 and 405.

The system 400 may include a controller 408. The controller 408 may include a sensor analyzer 410 that receives and interprets information from the sensor 401. For instance, the sensor analyzer 410 could be part of a radar system that, based on information received from the sensors, determines the location and/or motion of an item of interest. In some instances, one of the signals 403, 405 may interfere with other signals or each other. For instance, if signal 405 is from an item of interest (e.g., source 404 is an item of interest) and signal 403 is from a high-powered radio station in a region near the sensor, signal 403 may overpower signal 405 and make it difficult to analyze the position or other information related to source 404.

In accordance with the teachings herein, a heat source 108 may be provided to cause the PCM layer 104 to have shapes 106 of insulating state formed on it as shown in FIG. 4B to block or otherwise filter out the signals 403 from source 402. In the shown example, the heat source 108 includes laser diode 118 and gimballed mirror 114. Based on determinations made the sensor analyzer 410, a heat source controller 412 in the system controller 408 may cause control the heat source 108 such that desired shapes 106 are formed to remove or otherwise suppress interfering or overpowering signals. The above example utilizes shapes of an insulating state but it shall be understood that the shapes could be formed of a conductive state of the PCM.

As will be understood, as the PCM layer 104 can repeatedly be changed depending on the environment which it is operating. This will allow for context dependent input filtering.

Figure 5:
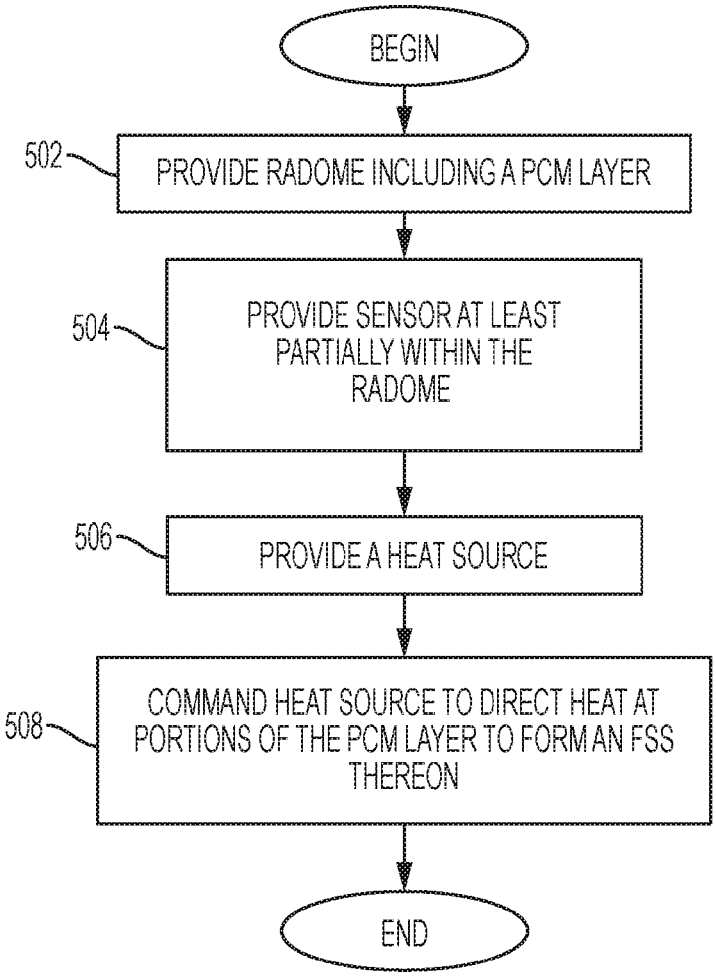
FIG. 5 is a flow chart depicting a method according to one embodiment.

FIG. 5 shows a method according to one embodiment. At block 502 a radome including a PCM layer disposed on an interior section is provided.

At block 504 a sensor, such as a phased array, is provided at least partially within the radome.

At block 506, a heat source is provided. The heat source may include a steering element and may be arranged such that the steering element may direct heat in the form of laser or other light towards at least a portion of the PCM layer.

At block 508 the heat source is commanded by, for example, a controller, to direct heat at portions of the PCM layer to form or alter an FSS thereon.

Figure 6:
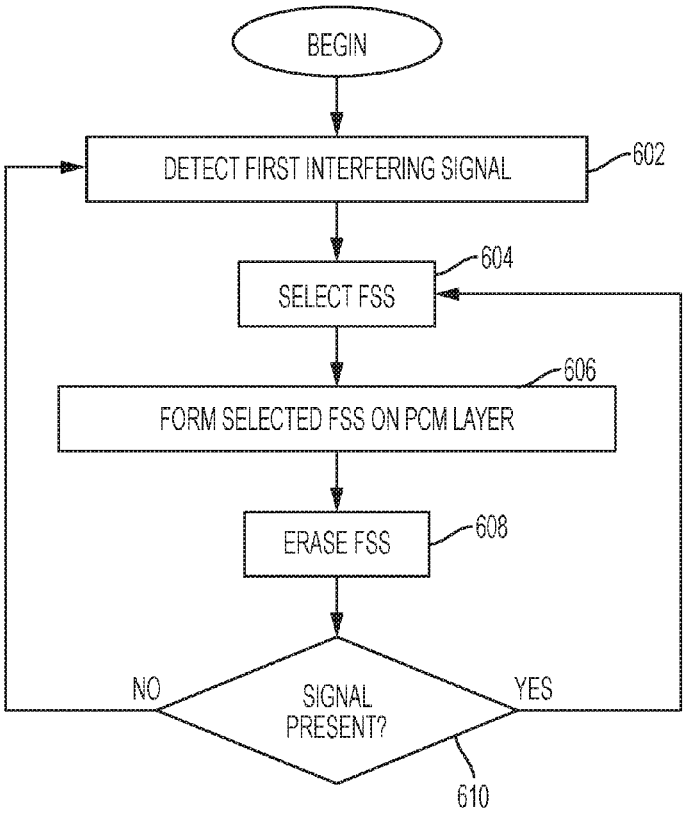
FIG. 6 is a flow chart depicting a method according to another embodiment.

FIG. 6 is a flow chart of another embodiment. The method of FIG. 6 may be performed in combination with, after, as a part of, or independently of the method of shown in FIG. 5.

At block 602 a first interfering signal is detected. Of course, the first interfering signal could be a frequency band that includes one or more frequencies. Such detection could be made by the sensor analyzer 402 determining that one or more frequencies or frequency bands are substantially larger than others.

At block 604 an FSS is selected that blocks the first interfering signal. The selection could be made by, for example, using a look up table containing FFS patterns cross referenced to frequency. Of course, other manners of selecting the FSS could be utilized.

At block the 606, the heat source controller 412 causes the heat source 108 to direct heat towards the PCM layer 104 to form the selected pattern on the PCM layer 104. As discussed above, this could include causing a laser beam to heat portions of the PCM layer 104 such that the portion is either conductive or insulating depending on the selected pattern.

At block 608 the pattern on the PCM layer 104 may be erased causing the radome 102 to pass all frequencies again. This may include causing the PCM layer to be completely conductive in one embodiment. Such a step may be performed to examine whether the first interfering signal is still present (block 610). If it is, processing returns to block 604. In such a case, the selecting step may include reapplying the prior pattern. If the first interfering signal is not present, then processing returns to block 602 where a new first interfering signal is searched for.

Figure 7:
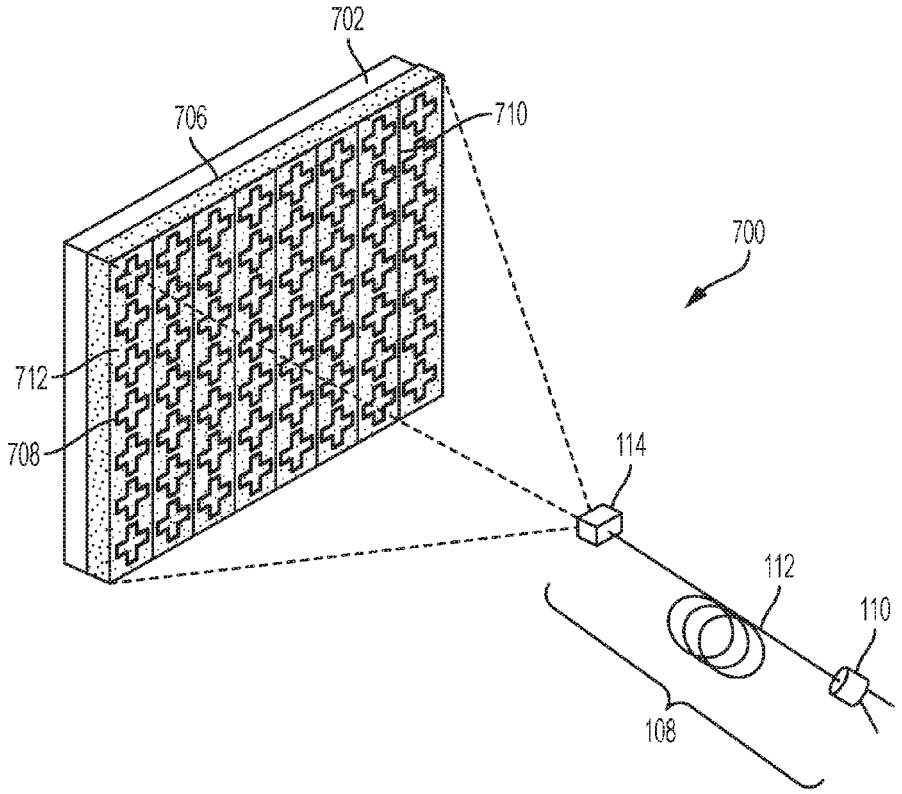
FIG. 7 shows a simplified block diagram of another system that may be used to form a frequency selective surface (FSS) on a surface such as an inner portion of a radome and includes a metal FSS.

FIG. 7 shows another embodiment of a system 700. In this embodiment, the radome 702 includes a filtering layer 704 disposed thereon. The filtering layer 704 in this embodiment includes two layers, a metal FSS 706 and a layer PCM layer 708 is shown. The PCM layer 708 may be formed of any PCM material. The ordering of the metal FSS 706 and the PCM layer 708 is such that the PCM material of the PCM layer 708 is disposed between features 710 of the metal FSS 706. This will allow heat source 108 to form patterns or shapes 712 of the PCM layer 706 such that the PCM layer becomes a frequency selective surface that filters out one or more frequencies. The combined metal FSS 706 and the shapes 712 on the PCM layer 706 will collectively form an FSS that is the combination of the two layers.

In the above example it was assumed that only one sensor was present. In another embodiment, an additional unshielded sensor may constantly analyze an environment and determine which FSS should be formed so that sensor 401 receives a clean signal absent major interfering signals.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A system for detecting radio frequency (RF) signals, the system comprising:

a radome, the radome including one or more phase change material (PCM) layers disposed on an inner surface thereof;

a sensor at least partially disposed within the radome;

a heat source arranged such that it can direct heat toward the inner surface of the radome; and a controller that causes the heat source to direct heat towards the inner surface of the radome such that a frequency selective surface (FSS) is formed thereon from the one or more PCM layers.

2. The system of claim 1, wherein the PCM layer includes chalcogenides disposed thereon.

3. The system of claim 1, wherein the sensor is a phased array sensor.

4. The system of claim 1, wherein the heat source includes a laser diode.

5. The system of claim 1, wherein the heat source includes a light emitting diode (LED).

6. The system of claim 1, wherein the heat source further includes a gimballed mirror to direct light emitted by the heat source.

7. The system of claim 1, wherein the controller includes a sensor analyzer that determines a first interfering frequency band.

8. The system of claim 1, wherein the controller selects the FSS based on the first interfering frequency band to block at least a portion of the first interfering frequency band from reaching the sensor.

9. The system of claim 8, wherein the metal FSS is formed over the one or more PCM layers such that is further from an inner surface of the radome than the one or more PCM layers.

10. The system of claim 1, wherein the radome includes a metal FSS formed such that the one or more PCM layers are exposed between elements of the metal FSS.

11. The system of claim 1, wherein the heat source is configured to cause at least one of the PCM layers to form a continuous, unpatterned resistive sheet of metallic character.

12. The system of claim 1, wherein the heat source is configured to cause at least one of the PCM layers to form a continuous, unpatterned resistive sheet of insulating character.

13. A system for filtering radio frequency (RF) signals from reaching an RF sensor, the system comprising:

a radome, the radome including one or more phase change material (PCM) layers disposed on an inner surface thereof;

a heat source arranged such that it can direct heat toward the inner surface of the radome; and a controller that causes the heat source to direct heat towards the inner surface of the radome such that a frequency selective surface (FSS) is formed thereon from the one or more PCM layers.

14. The system of claim 13, wherein at least one of the PCM layers includes chalcogenides.

15. The system of claim 13, wherein the heat source includes a laser diode.

16. The system of claim 13, wherein the heat source includes a light emitting diode (LED).

17. The system of claim 13, wherein the heat source further includes a gimballed mirror to direct light emitted by the heat source.

18. The system of claim 13, wherein the controller includes a sensor analyzer that determines a first interfering frequency band.

19. The system of claim 13, wherein the controller selects the FSS based on the first interfering frequency band to block at least a portion of the first interfering frequency band from reaching the sensor.

20. The system of claim 13, wherein the radome includes a metal FSS formed such that the one or more PCM layers are exposed between elements of the metal FSS.

21. The system of claim 20, wherein the metal FSS is formed over the one or more PCM layers such that is further from an inner surface of the radome than the one or more PCM layers.

22. The system of claim 20, wherein the metal FSS is formed over the one or more PCM layers such that is further from an inner surface of the radome than the one or more PCM layers.

23. A method of filtering signals from reaching a sensor, the method comprising:

providing a radome sized and configured to protect the sensor, the radome including one or more phase change material (PCM) layers disposed on an inner surface thereof;

determining a frequency band to be blocked from reaching the sensor;

selecting a first frequency selective surface (FSS) pattern to block the first frequency band; and directing heat at the PCM layer to cause the first FSS pattern to be formed thereon.

24. The method of claim 23, wherein at least one of the PCM layers includes chalcogenides.

25. The method of claim 23, further comprising:

directing heat at the PCM layer to remove the first FSS pattern.

26. The method of claim 23, further comprising:

determining a second frequency band to be blocked; and selecting a second FSS pattern to block the second frequency band; and directing heat at the PCM layer to cause the second FSS pattern to be formed thereon.

27. The method of claim 26, wherein the second frequency band is different than the first frequency band.

28. A system for detecting optical signals, the system comprising:

a radome, the radome including one or more phase change material (PCM) layers disposed on an inner surface thereof;

an optical sensor at least partially disposed within the radome;

a heat source arranged such that it can direct heat toward the inner surface of the radome; and a controller that causes the heat source to direct heat towards the inner surface of the radome such that a frequency selective surface (FSS) is formed thereon from the one or more PCM layers.

29. The system of claim 28, wherein at least one of the PCM layers includes chalcogenides.

30. The system of claim 28, wherein the heat source includes a laser diode.

31. The system of claim 28, wherein the heat source includes a light emitting diode (LED).

32. The system of claim 28, wherein the heat source further includes a gimballed mirror to direct light emitted by the heat source.

33. The system of claim 28, wherein the controller includes a sensor analyzer that determines a first interfering frequency band.

34. The system of claim 28, wherein the controller selects the FSS based on the first interfering frequency band to block at least a portion of the first interfering frequency band from reaching the sensor.

35. The system of claim 28, wherein the radome includes a metal FSS formed such that the one or more PCM layers are exposed between elements of the metal FSS.

36. The system of claim 28, wherein the heat source is configured to cause at least one of the PCM layers to form a continuous, unpatterned resistive sheet of metallic character.

37. The system of claim 28, wherein the heat source is configured to cause at least one of the PCM layers to form a continuous, unpatterned resistive sheet of insulating character.

* * * * *